United States Patent [19]

Kunihiro et al.

[11] Patent Number: 4,521,296

[45] Date of Patent: Jun. 4, 1985

[54] PROCESS FOR THE PRODUCTION OF REFRIGERATOR OIL

[75] Inventors: Takatoshi Kunihiro; Koji Tsuchiya, both of Sodegaura, Japan

[73] Assignee: Idemitsu Kosan Company Limited, Tokyo, Japan

[21] Appl. No.: 393,464

[22] Filed: Jun. 29, 1982

[30] Foreign Application Priority Data

Jul. 2, 1981 [JP] Japan ..... 56-102253

[51] Int. Cl.[3] ..... C10G 23/02

[52] U.S. Cl. ..... 208/87; 208/14

[58] Field of Search ..... 208/87, 14

[56] References Cited

U.S. PATENT DOCUMENTS 3,145,161 8/1964 Anderson et al. ..... 208/14 X
3,839,189 10/1974 Mills et al. ..... 208/18
3,849,288 11/1974 Milstein et al. ..... 208/144 X
3,880,747 4/1975 Mills et al. ..... 208/87
4,229,282 10/1980 Peters et al. ..... 208/87

*Primary Examiner*—D. E. Gantz
*Assistant Examiner*—Lance Johnson
*Attorney, Agent, or Firm*—Frishauf, Holtz, Goodman & Woodward

[57] ABSTRACT

A process for producing a high quality refrigerator oil from an oil fraction boiling at a temperature within boiling point of lubricating oil by contacting said oil fraction with a solvent to extract undesirable components thereby lowering % $C_A$ of said oil fraction, hydrogenating said solvent extracted fraction under the specific conditions, and then contacting said hydrogenated oil with a solid absorbant to remove impurities; said oil fraction being obtained from a low grade naphthenic crude oil.

9 Claims, No Drawings

PROCESS FOR THE PRODUCTION OF REFRIGERATOR OIL

BACKGROUND OF THE INVENTION

1. Field of the Invention

The present invention relates to a process for the production of high quality refrigerator oil from vacuum distillate of low grade naphthenic crude oil (Grade B).

2. Description of the Prior Art

Refrigerator oil has heretofore been produced from high grade naphthenic crude oil (Grade A) (National Petroleum Refiners Association, "Naphthenic Luboil Feedstock Availabilities", 1981 Fuels and Lubricants Meeting) having a very low impurities (wax, naphthenic acid, polycyclic aromatics, etc.) content. A method of production of such refrigerator oil involves distillating the crude oil to remove the light fraction and the vacuum residue contained therein and subjecting the resulting fraction to such treatments as solvent extraction, sulfuric acid washing, clay treatment etc. to remove the remaining impurities.

The high grade naphthenic crude oil (Grade A) which is suitable for the production of refrigerator oil is in short supply and will tend to gradually decrease until it is no longer available.

Under these circumstances, various methods have been proposed to produce refrigerator oil from paraffinic crude oil, including a method as described in Japanese Patent Publication No. 11940/1965 in which a base oil feed from a paraffinic crude oil is subjected to an extraction procedure to adjust the polycyclic aromatic compound content to less than 8% by weight and, thereafter, it is hydrogenated under a mild condition and then is subjected to a clay treatment, and a method as described in U.S. Pat. No. 3,702,817 and Japanese Patent Publication No. 10082/1978 in which, in the extraction of a paraffinic base oil, hydrogenation is performed under such severe conditions that the resulting aromatics in the extract are ring-opened. In accordance with these methods, however, sufficiently satisfactory results cannot be obtained. In order to lower the pour point, it is necessary to employ mild hydrogenation conditions so as not to cause hydrocracking. Hydrogenation under such mild conditions, however, gives rise to the problems that impurities are not removed, resulting in the formation of a large amount of sludge, and chemical stability against a freon is reduced. If, however, hydrogenation is performed under severe conditions, although the impurity content is reduced, wax is formed by hydrocracking. Because of the formation of this wax, the pour point and the cloud temperature for the ultimate refrigerator oil are not lowered. It also causes flock (floating solids such as wax) which precipitates when the refrigerator oil is mixed with freon.

Venezuela crude oil is produced in a relatively large amount. Although Venezuela crude oil is a naphthenic crude oil, it contains large amounts of impurities such as naphthenic acid, polyaromatics, nitrogen compounds, etc. Accordingly, it is called "Grade B" and a method of producing high quality refrigerator oil from such crude oils has not yet been developed, and only low quality base oils for use in process oil, etc. are now produced.

The term "high quality refrigerator oil" is used herein to mean a refrigerator oil having a good fluidity at low temperatures and a low cloud point, and it is required to be thermally stable at high temperatures, not to form sludge, and not to be corrosive. It is further required for the high quality refrigerator oil to have compatibility with liquid freon at low temperatures and not to cause precipitation of flock of wax or the like and corrosion of the metal surface.

SUMMARY OF THE INVENTION

An object of the invention is to provide a process for the production of high quality refrigerator oil from low grade naphthenic crude oil containing large amounts of impurities, e.g., Venezuela crude oil.

Another object of the invention is to provide a process for the production of high quality refrigerator oil from a naphthenic feed stock which has a high sulfur content and, as such, has poor stability and corrosion resistance, e.g., distillate from Venezuela crude oil.

The present invention, therefore, provides a process for producing a high quality refrigerator oil from an oil fraction boiling at a temperature within boiling point of lubricating oil, said oil fraction being obtained from a low grade naphthenic crude oil, which process comprises the steps of:

(1) contacting said oil fraction with a solvent to extract impurities thereby lowering the number of carbon atoms in aromatic ring structure per 100 carbon atoms (% $C_A$), as determined by a ring analysis, of said fraction to between 10 and 16;

(2) hydrogenating said solvent extracted oil fraction under the conditions of liquid hourly space velocity (LHSV) of from 0.1 to 0.7 per hour ($hr^{-1}$), pressure of from 40 to 100 kilograms per square centimeter ($kg/cm^2$), temperature of from 280° to 350° C., and hydrogen/oil ratio of from 70 to 200 normal cubic meter per kiloliter of oil ($Nm^3$/kl-oil) in the presence of catalyst comprising molybdenum and at least one metal selected from the group consisting of nickel and cobalt impregnated on aluminum; and (3) contacting said hydrogenated oil with a solid adsorbant to remove residual impurities and produce said high quality refrigerator oil.

DETAILED DESCRIPTION OF THE INVENTION

Feed stock for use in the process of the invention is an oil fraction boiling at a temperature within the boiling point of lubricating oil, said oil fraction being obtained from a low grade naphthenic crude oil such as Venezuela crude oil. Preferably said oil fraction is a vacuum distillate having an initial boiling point of above 270° C., and more preferably is a vacuum distillate having a boiling point in the range of from 270° to 510° C. Vacuum distillates may be employed as it is, or after fractionating them into some fractions such as Machine grade (corres. to VG 26, viscosity (at 40° C.) 24.2–28.8 cst, International Organization for Standardization (ISO)) having a boiling point in the range of from 280° C. (5% point) to 420° C. (95% point), and Motor grade (corres. to VG 100, viscosity (at 40° C.) 90.0–110 cst, ISO) having a boiling point in the range of from 300° C. (5% point) to 510° C. (95% point).

As an example of the low grade naphthenic crude oil (Grade B) (National Petroleum Refiners Association, "Naphthenic Luboil Feedstock Availabilities", 1981 Fuels and Lubricants Meeting), there is a naphthenic crude oil containing a fraction having a boiling point in the range of from 280 (5% point) to 510° C. (95% point), said fraction having a pour point of less than −20° C., a UOP characterization factor of from 11.20 to 11.45, a sulfur content of from 1.5 to 2.5% by weight, a nitrogen content of from 500 to 1,200 parts per million (ppm), and a total acid value of from 5 to 9 milligrams as KOH per gram (mgKOH/g).

In the first step of the process of the invention, the feed stock is subjected to solvent extraction for the purpose of adjusting the aromatic content to the desired level. It is preferred to control the aromatic compound content so that the % $C_A$ as determined by a ring analysis (a ndM method, ASTM D3238) is within the range of from 10 to 16. The preferred % $C_A$ differentiate within the above-specified range depending on the viscosity grade oil; for example, it is from 13 to 16 in Machine grade and from 10 to 13 in Motor grade.

When the % $C_A$ is less than the above-described range, the aromatic compound content and the naphthenic compound of the ultimate oil product after hydrogenation are low and, furthermore, the oil product has poor compatibility with liquid freon, causing layer-separation. On the other hand, when the % $C_A$ is more than the range, even after the hydrogenation, undesirable components such as nitrogen compounds, polycyclic aromatic compounds remain unremoved, deteriorating the oxidation stability and the thermal stability, and accelerating the formation of sludge. Thus, the adjustment (lowering) of the aromatic compound content in the first step of the process of the invention exerts great influence on the quality of the ultimate oil product and is a very significant procedure.

When the % $C_A$ was 10, the polycyclic aromatic compound content as determined by liquid chromatography was 12% by weight.

The above-described extraction process can be performed by various conventional techniques. For example, furfural or phenol is employed as a solvent and the solvent extraction procedure is performed under relatively mild conditions whereby the objects of the extraction as described hereinbefore can be achieved. Solvent extraction employing furfural is described in "Petroleum Processing Hand Book", chapter 3, page 87, by William F. Blad & Robert L. Davidson. In the solvent extraction of this invention, it is preferably carried out under conditions of volume ratio of the oil fraction to furfural of 0.7:1.0–1.2:1.0, column top temperature of from 60° to 80° C. and bottom temperature of from 35° to 55° C. when said oil fraction is Machine grade, and volume ratio of the oil fraction to furfural of 1.5:1.0–2.5:1.0, column top temperature of from 65° to 85° C. and bottom temperature of from 35° to 55° C. when said oil fraction is Motor grade.

The thus-treated oil is then subjected to a hydrogenation process in the second step of the process of the invention. The object of the hydrogenation is to remove substances which are responsible for the formation of sludge, thereby increasing the oxidation stability and the thermal stability of the ultimate oil product. In this hydrogenation treatment, nitrogen compounds contained in the feed are subjected to hydrogenation and removed, and polycyclic aromatic compounds are hydrogenated into naphthene ring compounds, or into isoparaffins, alkylaromatic compounds, and alkylnaphthenes.

The catalyst for use in the hydrogenation of the invention preferably comprises molybdenum and nickel and/or cobalt which are impregnated on an alumina carrier. The proportions of molybdenum, nickel, and cobalt in the catalyst are preferably from 5 to 15% by weight, from 0.3 to 6.0% by weight, and from 0.2 to 5.0% by weight, respectively, calculated as metal. Preferred examples include a catalyst comprising from 8 to 14% by weight Mo and from 1.5 to 5% by weight Ni, and a catalyst comprising from 5 to 12% by weight Mo, from 0.4 to 3% by weight Ni, and from 0.5 to 3% by weight Co. Various alumina carriers can be used in the invention, but they should not contain $SiO_2$ in an amount exceeding 0.5% by weight.

Preferably the hydrogenation is performed at a temperature of from 280° to 350° C., a pressure of from 40 to 100 kilograms per square centimeter, a liquid hourly space velocity (LHSV) of from 0.1 to 0.7 per hour ($hr^{-1}$), and a hydrogen/oil ratio of from 70 to 200 normal cubic meter per kiloliter of oil ($Nm^3$/kl-oil). When the temperature, pressure, and LHSV are outside the above-specified ranges, there cannot be obtained an oil product having desired properties and, furthermore, the oil product is not economical. The reaction temperature is preferably from 280° to 320° C. for Machine grade and from 310° to 350° C. for Motor grade.

In the third step of the process of the invention, i.e., solid absorption, various adsorption solids can be used which are generally used in purification of petroleum and purification of lubricating oil. Suitable examples include activated clay and activated alumina. The solid absorption treatment is performed at a temperature of from 30° to 100° C. and a ratio of solid adsorption agent to oil of from 0.5/100 to 10/100 by weight. This solid adsorption treatment removes impurities, nitrogen compounds, and polycyclic aromatic compounds which exert adverse influences on the thermal stability of the ultimate oil product.

The thus-produced refrigerator oil has a pour point of less than −25° C. and a cloud temperature of less than −15° C., does not cause deposition when maintained at 170° C. for 12 hours on Machine grade oil and at 170° C. for 24 hours on Motor grade oil, has a two layer-separation temperature of less than 0° C. when Machine grade oil is used and of less than 20° C. when Motor grade oil is used, and has a hydrochloric acid generation amount, as determined by the sealed tube test, of less than 10 milligrams per 4 milliliters (mg/4 ml). The refrigerator oil of the invention has advantages in that it is stable, the formation of sludge is reduced, its stability against and compatibility with a freon are good, and, even at low temperatures, layer separation and flock formation due to wax and the like do not occur. Thus, the refrigerator oil of the invention is a high quality oil product.

The following examples are given to illustrate the invention in greater detail.

EXAMPLES 1 TO 4 AND COMPARATIVE EXAMPLES 1 TO 3

A vacuum distillate having the properties as described hereinafter was used as a feed stock, which was obtained by vacuum distillation of Tia Juana topped crude oil from Venezuela.

Machine grade;
Viscosity at 40° C.: 52.98 centistokes (cst);
Boiling point range: 280° C. (5% point) to 420° C. (95% point);
UOP characterization factor: 11.22;
Sulfur content: 2.1% by weight;
Nitrogen content: 600 parts per million (ppm);
Total acid value: 7.0 milligrams as KOH per gram (mg KOH/g);

Wax content: Not detected

Ring analysis by the ndM method: % $C_A$=25.0, % $C_N$=41.0, % $C_P$=34.0

The vacuum distillate feed stock was brought into contact with furfural in a counter-current contact type extraction column to adjust the aromatic compound content. The volume ratio of the feed stock to furfural was 1:1, and the extraction was performed at a column top temperature of 70° C. and a bottom temperature of 45° C. The properties of the raffinate (extraction-treated oil) thus obtained are shown in Table 1, in which % $C_A$ indicates the number of carbon atoms in aromatic ring structure per 100 carbon atom, % $C_N$, the number of naphthenic carbon, % Cp, the number of paraffinic carbon, and % $C_R$, the number of ring structure carbon.

The extraction-treated oil was then subjected to a hydrogenation process; that is, it was hydrogenated under the conditions shown in Table 1 by a bench scale isothermal hydrogenation unit in the presence of a catalyst which had been preliminarily sulfided.

Subsequently the oil thus hydrogenated was brought into contact with 8% by weight of clay at 60° C. to achieve an adsorption treatment.

After the hydrogenation and the clay treatment, the properties of the refrigerator oil obtained were analyzed, and the results are shown in Table 1.

The catalysts used were Catalyst A comprising 0.6% by weight Ni, 1.0% by weight Co, and 7.0% by weight Mo, impregnated on a γ-alumina carrier, Catalyst B comprising 4.2% by weight Ni, and 12.7% by weight Mo, impregnated on a γ-alumina carrier, and Catalyst C comprising 2.5% by weight Ni, and 10.3% by weight Mo, impregnated on a γ-alumina carrier.

EXAMPLES 5 TO 18 AND COMPARATIVE EXAMPLES 4 TO 11

A raffinate was produced in the same procedure as in Example 1 except that there was used, as the vacuum distillate, Motor grade oil having the properties as described hereinafter, the extraction using furfural was performed at a volume ratio of vacuum distillate to furfural of 2:1, and the top temperature and bottom temperature of the extraction column were set to 75° C. and 45° C., respectively.

Motor grade

Boiling point range: 300° C. (5% point) to 510° C. (95% point);

Viscosity at 100° C.: 13.00 centistokes (cst);

UOP characterization factor: 11.33;

Sulfur content: 2.24% by weight;

Nitrogen content: 1,100 parts per million (ppm);

Total acid value: 7.3 milligrams as KOH per gram (mg KOH/g);

Wax content: Not detected

Ring analysis by the ndM method: % $C_A$=26.5, % $C_N$=38.0, % $C_P$=35.5.

The raffinate thus obtained was hydrogenated under the conditions shown in Table 2 and was further subjected to the same clay treatment as in Example 1. After the hydrogenation and the clay treatment, the properties of the refrigerator oil obtained were analyzed, and the results are shown in Table 2. Catalyst A, B, and C shown in Table 2 were the same as described in Examples 1 to 4.

COMPARATIVE EXAMPLES 12 AND 13

The same feed stock (Motor grade) as used in Example 5 was brought into contact with furfural in a counter current type extraction column at a volume ratio of said feed stock to furfural of 2.8:1, and an extraction column top temperature of 85° C. and a bottom temperature of 45° C. to adjust the aromatic compound content. The properties of the raffinate after the extraction are shown in Table 3.

The raffinate was then hydrogenated. In this hydrogenation, the same Catalyst A as used in Example 1 was employed, and it was performed under the conditions of a reaction temperature of 240° C. (Comparative Example 12) or 180° C. (Comparative Example 13), a pressure of 60 kilograms per square centimeter (kg/cm$^2$), LHSV of 1.0 per hour (hr$^{-1}$), and $H_2$/oil of 100 normal cubic meter per kiloliter of oil (Nm$^3$/kl-oil).

The raffinate thus hydrogenated was brought into contact with 8% by weight of clay at 60° C. to perform an adsorption treatment.

After the hydrogenation and the clay treatment, the properties of the refrigerator oil obtained were analyzed, and the results are shown in Table 3.

COMPARATIVE EXAMPLES 14 AND 15

A raffinate was produced in the same manner as in Comparative Examples 12 and 13 except that the extraction was performed at volume ratio of the feed stock to furfural of 2.0:1.0. The raffinate was then hydrogenated. In this hydrogenation, catalysts were used Catalyst B in Comparative Example 14 and Catalyst C in Comparative Example 15, and it was performed under the condition of a reaction temperature of 270° C. (Comparative Example 14) and of 260° C. (Comparative Example 15), a pressure of 60 kg/cm$^2$, LHSV of 1.0 hr$^{-1}$, and $H_2$/oil of 100 Nm$^3$/kg-oil.

The properties of the raffinate, and the properties of the refrigerator oil obtained after the hydrogenation treatment and the clay treatment were analyzed. The results are shown in Table 4.

COMPARATIVE EXAMPLE 16 TO 18

A raffinate was produced in the same manner as in Example 5 and the hydrogenation was performed under the conditions shown in Table 5.

COMPARATIVE EXAMPLE 19

A raffinate was produced in the same manner as in Example 5 except that there was used, as the vacuum distillate, Motor grade oil of different lot, the extraction using furfural was performed at volume ratio of the feed stock to furfural of 1:1, and the extraction column top temperature of 50° C. and bottom temperature of 22° C.

And the, the hydrogenation was performed under the conditions shown in Table 5.

The properties of the raffinate, and the properties of the refrigerator oil obtained after the hydrogenation and the clay treatment were analyzed. The results are shown in Table 5.

TABLE 1

| | Properties of Raffinate | Comp. Ex. 1 | Comp. Ex. 2 | Ex. 1 | Ex. 2 | Comp. Ex. 3 | Ex. 3 | Ex. 4 |
|---|---|---|---|---|---|---|---|---|
| Condition of Hydrogenation | | | | | | | | |

TABLE 1-continued

| | Properties of Raffinate | Comp. Ex. 1 | Comp. Ex. 2 | Ex. 1 | Ex. 2 | Comp. Ex. 3 | Ex. 3 | Ex. 4 |
|---|---|---|---|---|---|---|---|---|
| Catalyst | | A | A | A | A | A | B | C |
| Reaction Temperature (°C.) | | 260 | 270 | 290 | 320 | 330 | 290 | 290 |
| Reaction Pressure (kilogram per cubic centimeter by gauge ($kg/cm^3G$)) | | 60 | 60 | 60 | 60 | 60 | 60 | 60 |
| LHSV (per hour ($hr^{-1}$)) | | 0.5 | 0.5 | 0.5 | 0.5 | 0.5 | 0.5 | 0.5 |
| $H_2$/oil (normal cubic meter per kiloliter ($Nm^3/kl$)) | | 150 | 150 | 150 | 150 | 150 | 190 | 160 |
| Properties | | | | | | | | |
| Specific Gravity (15/4° C.) | 0.9136 | 0.9090 | 0.9070 | 0.9037 | 0.9000 | 0.8970 | 0.9032 | 0.9031 |
| Color (ASTM) | L2.5 | L0.5 | L0.5 | L0.5 | L0.5 | L0.5 | L0.5 | L0.5 |
| Viscosity at 40° C. (centistoke (cst)) | 29.34 | 27.31 | 26.65 | 25.36 | 24.32 | 23.55 | 25.67 | 25.40 |
| at 100° C. (centistoke (cst)) | 4.283 | 4.145 | 4.094 | 3.995 | 3.920 | 3.865 | 4.025 | 4.017 |
| Viscosity Index | −7 | −5 | −4 | −3 | 2 | 5 | −1 | 1 |
| Pour Point (°C.) | less than −40 | less than −40 | less than −40 | less than −40 | less than −40 | less than −40 | less than −40 | less than −40 |
| Cloud Temperature (°C.)*1 | less than −30 | −25 | −25 | −25 | −23 | 0 | −17 | −15 |
| Sulfur Content (percent by weight (wt %)) | 1.42 | 1.10 | 0.94 | 0.64 | 0.36 | 0.25 | 0.61 | 0.60 |
| Nitrogen Content (part per million (ppm)) | 170 | 30 | 30 | 20 | 20 | 20 | 20 | 20 |
| Aniline Point (°C.) | 68.4 | 71.8 | 72.2 | 72.8 | 75.5 | 76.7 | 73.6 | 73.8 |
| Total Acid Value (milligram as KOH per gram (mg KOH/g)) | 1.91 | 0.01 | 0.01> | 0.01> | 0.01> | 0.01> | 0.01> | 0.01> |
| Ring Analysis | | | | | | | | |
| % $C_A$/% $C_R$ | 14.6/51.4 | 14.2/50.8 | 14.0/50.6 | 13.5/50.7 | 12.5/50.7 | 11.7/50.3 | 13.0/50.8 | 13.1/50.6 |
| % $C_N$/% $C_P$ | 36.8/48.5 | 36.5/49.2 | 36.6/49.4 | 37.2/49.3 | 38.2/49.3 | 38.6/49.7 | 37.8/49.2 | 37.4/49.4 |
| Polycyclic Aromatic Compound Content (percent by weight) | 16.6 | — | — | — | — | — | — | — |
| Thermal Stability*2 | | | | | | | | |
| 170° C. × 12 hours (Separating) | positive (sludge) | positive | negative | negative | negative | positive | negative | negative |
| 170° C. × 24 hours (Separating) | — | — | — | — | — | — | — | — |
| Two Layer Separation Temperature with Freon (°C.)*3 | — | −15.0 | −15.0 | −15.0 | −15.0 | −15.0 | −15.0 | −15.0 |
| Hydrochloric Acid Generation Amount as*4 determined by Sealed Tube Test (milligram per 4 milliliter (mg/4 ml)) | — | 80.5 | 19.65 | 4.26 | 2.56 | 2.60 | 9.93 | 3.81 |

Note

*1The test procedure is just the same to cloud point (JIS K2269). The definition of "cloud temperature" is a temperature that slightly whity mist appear in the bottom of a test tube. (same with the subsequent tables)

*2According to JIS K2540 (same with subsequent tables).

*3A 10-milliliter tube-type pressure ampoule made of glass was charged with about from 5 to 6 grams of a mixture of oil and freon and sealed. It was then placed in a low temperature bath and held in position, and the temperature at which the mixture was separated into two layers of oil and freon was measured (same with the subsequent tables).

*4Into a 10 milliliters tube-type pressure ampoule made of glass in which wires of steel, copper and aluminum had been placed was introduced 4 milliliters of an oil sample by the use of a syringe and, thereafter, the air remaining dissolved in the oil sample was removed. The tube-type pressure ampoule was charged with 1.2 grams of freon, dichlorodifluoromethane, while cooling with liquid nitrogen and sealed by means of a burner. The thus-sealed tube-type pressure ampoule was placed in an oil bath maintained at 170° C. and was allowed to keep for 250 hours. At the end of the time, the tube-type pressure ampoule was cooled with liquid nitrogen and partially broken. The oil sample was then extracted with water and titrated with a 1/10 normal (N) potassium hydroxide (KOH) solution to determine the amount of hydrochloric acid generated (same with the subsequent tables).

TABLE 2

| | Properties of Raffinate | Ex. 5 | Comp. Ex. 4 | Ex. 6 | Ex. 7 | Ex. 8 | Ex. 9 | Comp. Ex. 5 |
|---|---|---|---|---|---|---|---|---|
| Conditions of Hydrogenation | | | | | | | | |
| Catalyst | | A | B | B | B | B | B | B |
| Reaction Temperature (°C.) | | 320 | 320 | 320 | 320 | 320 | 320 | 320 |
| Reaction Pressure (kilogram per cubic centimeter by gauge ($kg/cm^3G$)) | | 60 | 60 | 60 | 60 | 60 | 60 | 60 |
| LHSV (per hour ($hr^{-1}$)) | | 0.5 | 0.5 | 0.5 | 0.5 | 0.5 | 0.5 | 0.5 |
| $H_2$/oil (normal cubic meter per kiloliter ($Nm^3/kl$)) | | 150 | 50 | 80 | 120 | 180 | 190 | 220 |
| Properties | | | | | | | | |
| Specific Gravity (15/4° C.) | 0.9169 | 0.9051 | 0.9043 | 0.9041 | 0.9040 | 0.9037 | 0.9039 | 0.9037 |
| Color (ASTM) | L2.5 | L0.5 | L0.5 | L0.5 | L0.5 | L0.5 | L0.5 | L0.5 |
| Viscosity at 40° C. (centistoke (cst)) | 122.8 | 93.81 | 94.45 | 93.54 | 93.15 | 92.58 | 92.81 | 92.33 |
| at 100° C. (centistoke (cst)) | 9.567 | 8.402 | 8.382 | 8.358 | 8.338 | 8.320 | 8.319 | 8.295 |
| Viscosity Index | 24 | 34 | 32 | 33 | 33 | 33 | 33 | 33 |
| Pour Point (°C.) | −27.5 | −30.0 | −30.0 | −30.0 | −30.0 | −30.0 | −30.0 | −30.0 |
| Cloud Temperature (°C.)*1 | −10 | −22 | −15 | −17 | −17 | −15 | −17 | −15 |
| Sulfur Content (percent by weight (wt %)) | 1.33 | 0.31 | 0.30 | 0.27 | 0.26 | 0.23 | 0.23 | 0.22 |
| Nitrogen Content (part per million (ppm)) | 240 | 30 | 20 | 20 | 20 | 20 | 20 | 20 |
| Aniline Point (°C.) | 83.0 | 88.5 | 89.7 | 90.2 | 90.4 | 90.6 | 90.6 | 90.9 |
| Total Acid Value (milligram as KOH | 1.51 | 0.01> | 0.01> | 0.01> | 0.01> | 0.01 | 0.01> | 0.01> |

TABLE 2-continued

| | | | | | | | | |
|---|---|---|---|---|---|---|---|---|
| per gram (mg KOH/g)) | | | | | | | | |
| Ring Analysis | | | | | | | | |
| % $C_A$/% $C_R$ | 11.0/48.0 | 9.7/47.2 | 9.4/47.4 | 9.3/47.4 | 9.2/47.4 | 9.3/47.4 | 9.3/47.5 | 9.3/47.4 |
| % $C_N$/% $C_P$ | 37.0/52.0 | 37.5/52.8 | 38.0/52.6 | 38.1/52.6 | 38.2/52.6 | 38.1/52.6 | 38.2/52.5 | 38.2/52.6 |
| Polycyclic Aromatic Compound Content (percent by weight) | 12.8 | — | — | — | — | — | — | — |
| Thermal Stability*2 | | | | | | | | |
| 170° C. × 12 hours (Separating) | positive (cloud) | negative | — | — | — | — | — | — |
| 170° C. × 24 hours (Separating) | — | negative | positive | negative | negative | negative | negative | negative |
| Two Layer Separation Temperature with Freon (°C.)*3 | — | 21.0 | 20.5 | 20.5 | 20.5 | 21.0 | 21.0 | 21.0 |
| Hydrochloric Acid Generation Amount as determined by Sealed Tube Test (milligram per 4 milliliter (mg/4 ml))*4 | — | 0.55 | 15.9 | 3.0 | 2.4 | 2.01 | 2.4 | 2.4 |

| | Ex. 10 | Comp. Ex. 6 | Comp. Ex. 7 | Ex. 11 | Ex. 12 | Comp. Ex. 8 | Comp. Ex. 9 | Ex. 13 |
|---|---|---|---|---|---|---|---|---|
| Conditions of Hydrogenation | | | | | | | | |
| Catalyst | C | A | A | A | A | A | B | B |
| Reaction Temperature (°C.) | 340 | 290 | 300 | 320 | 350 | 360 | 320 | 320 |
| Reaction Pressure (kilogram per cubic centimeter by gauge (kg/cm$^3$G)) | 60 | 60 | 60 | 60 | 60 | 60 | 20 | 40 |
| LHSV (per hour (hr$^{-1}$)) | 0.5 | 0.5 | 0.5 | 0.5 | 0.5 | 0.5 | 0.5 | 0.5 |
| $H_2$/oil (normal cubic meter per kiloliter (Nm$^3$/kl)) | 150 | 150 | 150 | 150 | 150 | 150 | 150 | 150 |
| Properties | | | | | | | | |
| Specific Gravity (15/4° C.) | 0.9017 | 0.9095 | 0.9078 | 0.9050 | 0.9003 | 0.8990 | 0.9048 | 0.9043 |
| Color (ASTM) | L0.5 | L0.5 | L0.5 | L0.5 | L0.5 | L0.5 | L0.5 | L0.5 |
| Viscosity at 40° C. (centistoke (cst)) | 86.30 | 103.7 | 99.80 | 93.82 | 85.42 | 80.80 | 94.12 | 93.25 |
| at 100° C. (centistoke (cst)) | 8.084 | 8.805 | 8.642 | 8.402 | 8.070 | 7.875 | 8.365 | 8.343 |
| Viscosity Index | 38 | 30 | 31 | 34 | 39 | 42 | 32 | 33 |
| Pour Point (°C.) | −30.0 | −27.5 | −30.0 | −30.0 | −30.0 | −27.5 | −30.0 | −30.0 |
| Cloud Temperature (°C.)*1 | −17 | −17 | −17 | −17 | −15 | 0 | −15 | −17 |
| Sulfur Content (percent by weight (wt %)) | 0.11 | 0.70 | 0.53 | 0.31 | 0.1 | 0.08 | 0.29 | 0.25 |
| Nitrogen Content (part per million (ppm)) | 20 | 30 | 30 | 30 | 20 | 20 | 30 | 20 |
| Aniline Point (°C.) | 91.6 | 87.5 | 88.2 | 88.5 | 90.6 | 92.0 | 90.3 | 90.6 |
| Total Acid Value (milligram as KOH per gram (mg KOH/g)) | 0.01> | 0.01> | 0.01> | 0.01> | 0.01> | 0.01> | 0.01> | 0.01> |
| Ring Analysis | | | | | | | | |
| % $C_A$/% $C_R$ | 8.6/47.1 | 10.4/47.4 | 10.1/47.4 | 9.7/47.1 | 8.1/46.6 | 7.8/46.3 | 9.6/47.5 | 9.4/47.5 |
| % $C_N$/% $C_P$ | 38.5/52.9 | 37.0/52.6 | 37.3/52.6 | 37.4/52.9 | 38.5/53.4 | 38.5/53.7 | 37.9/52.5 | 38.1/52.5 |
| Polycyclic Aromatic Compound Content (percent by weight) | — | — | — | — | — | — | — | — |
| Thermal Stability*2 | | | | | | | | |
| 170° C. × 12 hours (Separating) | negative | — | — | — | — | — | — | — |
| 170° C. × 24 hours (Separating) | negative | negative | negative | negative | negative | positive | positive (cloud) | negative |
| Two Layer Separation Temperature with Freon (°C.)*3 | 21.0 | 19.5 | 19.5 | 21.0 | 21.0 | 30.0 | 20.5 | 20.0 |
| Hydrochloric Acid Generation Amount as determined by Sealed Tube Test (milligram per 4 milliliter (mg/4 ml))*4 | 0.93 | 82.5 | 24.46 | 0.55 | 0.57 | 0.70 | 26.7 | 3.0 |

| | Ex. 14 | Ex. 15 | Comp Ex. 10 | Ex. 16 | Ex. 17 | Ex. 18 | Comp. Ex. 11 |
|---|---|---|---|---|---|---|---|
| Conditions of Hydrogenation | | | | | | | |
| Catalyst | B | B | B | C | C | C | C |
| Reaction Temperature (°C.) | 320 | 320 | 320 | 330 | 330 | 330 | 330 |
| Reaction Pressure (kilogram per cubic centimeter by gauge (kg/cm$^3$G)) | 80 | 100 | 120 | 60 | 60 | 60 | 60 |
| LHSV (per hour (hr$^{-1}$)) | 0.5 | 0.5 | 0.5 | 0.2 | 0.6 | 0.7 | 0.8 |
| $H_2$/oil (normal cubic meter per kiloliter (Nm$^3$/kl)) | 150 | 150 | 150 | 150 | 150 | 150 | 150 |
| Properties | | | | | | | |
| Specific Gravity (15/4° C.) | 0.9037 | 0.9022 | 0.9025 | 0.9015 | 0.9038 | 0.9045 | 0.9064 |
| Color (ASTM) | L0.5 | L0.5 | L0.5 | L0.5 | L0.5 | L0.5 | L0.5 |
| Viscosity at 40° C. (centistoke (cst)) | 92.43 | 92.01 | 91.19 | 85.73 | 91.55 | 93.25 | 98.07 |
| at 100° C. (centistoke (cst)) | 8.300 | 8.278 | 8.258 | 8.035 | 8.300 | 8.353 | 8.574 |
| Viscosity Index | 33 | 33 | 34 | 37 | 35 | 33 | 32 |
| Pour Point (°C.) | −30.0 | −30.0 | −30.0 | −30.0 | −30.0 | −30.0 | −30.0 |
| Cloud Temperature (°C.)*1 | −15 | −15 | −12 | −15 | −17 | −17 | −17 |
| Sulfur Content (percent by weight (wt %)) | 0.22 | 0.20 | 0.19 | 0.1 | 0.24 | 0.26 | 0.43 |
| Nitrogen Content (part per million (ppm)) | 20 | 20 | 20 | 20 | 20 | 20 | 20 |
| Aniline Point (°C.) | 90.9 | 91.0 | 91.4 | 91.5 | 90.5 | 90.1 | 89.1 |
| Total Acid Value (milligram as KOH per gram (mg KOH/g)) | 0.01> | 0.01> | 0.01> | 0.01> | 0.01> | 0.01> | 0.01> |
| Ring Analysis | | | | | | | |
| % $C_A$/% $C_R$ | 9.1/47.5 | 9.0/47.5 | 8.9/47.2 | 8.4/47.3 | 9.1/47.3 | 9.5/47.3 | 9.9/47.3 |
| % $C_N$/% $C_P$ | 38.4/52.5 | 38.5/52.5 | 38.3/52.8 | 38.9/52.3 | 38.2/52.7 | 38.0/52.7 | 37.4/52.7 |

TABLE 2-continued

| | | | | | | | |
|---|---|---|---|---|---|---|---|
| Polycyclic Aromatic Compound Content (percent by weight) | — | — | — | — | — | — | — |
| Thermal Stability*2 | | | | | | | |
| 170° C. × 12 hours (Separating) | — | — | — | — | — | — | — |
| 170° C. × 24 hours (Separating) | negative | negative | negative | negative | negative | negative | negative |
| Two Layer Separation Temperature with Freon (°C.)*3 | 20.5 | 20.5 | 21.0 | 21.0 | 21.0 | 21.0 | 21.0 |
| Hydrochloric Acid Generation Amount as determined by Sealed Tube Test (milligram per 4 milliliter (mg/4 ml))*4 | 2.4 | 2.5 | 2.5 | 1.02 | 3.09 | 6.36 | 29.36 |

TABLE 3

| | Properties of Raffinate | Comp. Ex. 12 | Comp. Ex. 13 |
|---|---|---|---|
| Properties | | | |
| Specific Gravity (15/4° C.) | 0.9001 | 0.8988 | 0.8998 |
| Color (ASTM) | L2.5 | L0.5 | L0.5 |
| Viscosity at 40° C. (centistoke (cst)) | 107.8 | 104.5 | 107.4 |
| at 100° C. (centistoke (cst)) | 9.293 | 9.164 | 9.267 |
| Viscosity Index | 40 | 42 | 40 |
| Pour Point (°C.) | −25.0 | −25.0 | −25.0 |
| Cloud Temperature (°C.)*1 | +7 | +8 | +5 |
| Sulfur Content (percent by weight (wt %)) | 0.70 | 0.60 | 0.68 |
| Nitrogen Content (part per million (ppm)) | — | — | — |
| Aniline Point (°C.) | 96.3 | 97.4 | 96.8 |
| Total Acid Value (milligram as KOH per gram (mg KOH/g)) | 0.25 | 0.01 | 0.01 |
| Ring Analysis | | | |
| % $C_A$/% $C_R$ | 5.2/45.1 | 5.0/44.8 | 5.1/45.1 |
| % $C_N$/% $C_P$ | 39.9/54.9 | 39.8/55.2 | 40.0/54.9 |
| Thermal Stability*2 | | | |
| 170° C. × 12 hours (Separating) | positive | negative | negative |
| 170° C. × 24 hours (Separating) | — | positive | negative |
| Two Layer Separation Temperature with Freon (°C.)*3 | — | 45 | 40 |
| Hydrochloric Acid Generation Amount as determined by*4 Sealed Tube Test (milligram per 4 milliliter (mg/4 ml)) | — | 6.9 | 48.0 |

TABLE 4

| | Properties of Raffinate | Comp. Ex. 14 | Comp. Ex. 15 |
|---|---|---|---|
| Properties | | | |
| Specific Gravity (15/4° C.) | 0.9068 | 0.9010 | 0.9047 |
| Color (ASTM) | L2.5 | L0.5 | L0.5 |
| Viscosity at 40° C. (centistoke (cst)) | 107.3 | 101.2 | 103.4 |
| at 100° C. (centistoke (cst)) | 9.157 | 9.029 | 8.975 |
| Viscosity Index | 37 | 43 | 37 |
| Pour Point (°C.) | −25.0 | −25.0 | −22.5 |
| Cloud Temperature (°C.)*1 | +9 | — | +8 |
| Sulfur Content (percent by weight (wt %)) | 0.94 | 0.53 | 0.79 |
| Nitrogen Content (part per million (ppm)) | 100 | — | 30 |
| Aniline Point (°C.) | 90.7 | 95.6 | 91.8 |
| Total Acid Value (milligram as KOH per gram (mg KOH/g)) | 0.49 | 0.01 | 0.01 |
| Ring Analysis | | | |
| % $C_A$/% $C_R$ | 6.4/47.2 | 6.4/45.3 | 7.0/46.5 |
| % $C_N$/% $C_P$ | 40.8/52.8 | 38.9/54.7 | 39.5/53.5 |
| Thermal Stability*2 | | | |
| 170° C. × 12 hours (Separating) | positive | positive | negative |
| 170° C. × 24 hours (Separating) | — | — | — |
| Two Layer Separation Temperature with Freon (°C.)*3 | — | 40 | 40 |
| Hydrochloric Acid Generation Amount as determined by*4 Sealed Tube Test (milligram per 4 milliliter (mg/4 ml)) | — | 37.80 | 115 |

TABLE 5

| | Properties of Raffinate | Comp. Ex. 16 | Comp. Ex. 17 | Comp. Ex. 18 | Properties of Raffinate | Comp. Ex. 19 |
|---|---|---|---|---|---|---|
| Conditions of Hydrogenation | | | | | | |
| Catalyst | | D | E | F | | A |
| Reaction Temperature (°C.) | | 300 | 320 | 300 | | 320 |
| Reaction Pressure (kilogram per cubic centimeter by gauge (kg/cm$^3$G)) | | 60 | 60 | 60 | | 60 |
| LHSV (per hour (hr$^{-1}$)) | 0.50 | 0.50 | 0.50 | | 0.50 | |
| $H_2$/oil (normal cubic meter per kiloliter (Nm$^3$/kl)) | 170 | 170 | 160 | | 100 | |

TABLE 5-continued

| | Properties of Raffinate | Comp. Ex. 16 | Comp. Ex. 17 | Comp. Ex. 18 | Properties of Raffinate | Comp. Ex. 19 |
|---|---|---|---|---|---|---|
| Properties | | | | | | |
| Specific Gravity (15/4° C.) | 0.9169 | 0.9072 | 0.9051 | 0.9132 | 0.9329 | 0.9224 |
| Color (ASTM) | L2.5 | L0.5 | L0.5 | L0.5 | L7.5 | L0.5 |
| Viscosity at 40° C. (centistoke (cst)) | 122.8 | 99.69 | 92.80 | 111.7 | 184.4 | 138.8 |
| at 100° C. (centistoke (cst)) | 9.567 | 8.648 | 8.365 | 9.127 | 11.83 | 10.01 |
| Viscosity Index | 24 | 32 | 35 | 27 | 14 | 14 |
| Pour Point (°C.) | −27.5 | −27.5 | −30.0 | −30.0 | −27.5 | −27.5 |
| Cloud Temperature (°C.)*1 | −10 | −20 | −17 | −22 | −30 | −22 |
| Sulfur Content (percent by weight (wt %)) | 1.33 | 0.47 | 0.31 | 1.07 | 1.70 | 1.19 |
| Nitrogen Content (part per million (ppm)) | 240 | 30 | 20 | 30 | — | — |
| Aniline Point (°C.) | 83.0 | 88.8 | 89.5 | 85.5 | 72.6 | 82.4 |
| Total Acid Value (milligram as KOH per gram (mg KOH/g)) | 1.51 | 1.51 | 1.51 | 0.01 | 5.06 | 0.01 |
| Ring Analysis | | | | | | |
| % $C_A$/% $C_R$ | 11.0/48.0 | 10.1/47.3 | 9.5/47.4 | 11.0/47.3 | 16.3/48.5 | 14.8/47.9 |
| % $C_N$/% $C_P$ | 37.0/52.0 | 37.2/52.7 | 37.9/52.6 | 36.3/52.7 | 32.3/51.5 | 33.1/52.1 |
| Thermal Stability*2 | | | | | | |
| 170° C. × 12 hours (Separating) | positive (cloud) | negative | negative | negative | positve (sludge) | positive (cloud) |
| 170° C. × 24 hours (Separating) | — | positive | positive | negative | — | — |
| Two Layer Separation Temperature with Freon (°C.)*3 | — | 19.5 | 21.0 | 19.0 | — | 10.0 |
| Hydrochloric Acid Generation Amount as determined*4 by Sealed Tube Test (milligram per 4 milliliter (mg/4 ml)) | — | 36.01 | 13.73 | 75.92 | — | 130.0 |

*Catalyst
D: Alumina carrier (containing 1% weight of $SiO_2$), 10% by weight Mo, 2.5% by weight Ni, and 1.5% by weight Co
E: Alumina carrier, 4.0% by weight Ni, and 16.0% by weight W
F: Kieselguhr carrier, 45.0% by weight Ni, 2.5% by weight Cr, and 2.5% by weight Cu
A: Same as in Example 1

What is claimed is:

1. A process for producing a high quality refrigerator oil from a vacuum distillate having a boiling point in the range of from 270° to 510° C. obtained from a low grade naphthenic crude oil containing a fraction having a boiling point in the range of from 280° (5% point) to 510° C. (95% point), said fraction having a pour point of less than −20° C., a UOP characterization factor of from 11.20 to 11.45, a sulfur content of from 1.5 to 2.5% by weight, a nitrogen content of from 500 to 1,200 ppm, and a total acid value of from 5 to 9 mgKOH/g, which process comprises the steps of:

(1) contacting said vacuum distillate with a solvent to extract impurities thereby lowering the number of carbon atoms in aromatic ring structure per 100 carbon atoms (% $C_A$), as determined by a ring analysis, of said fraction to between 10 and 16;

(2) hydrogenating said solvent extracted fraction under the conditions of liquid hourly space velocity (LHSV) of from 0.1 to 0.7 per hour ($hr^{-1}$), pressure of from 40 to 100 kilograms per square centimeter ($kg/cm^2$), temperature of from 280° to 350° C., and hydrogen/oil ratio of from 70 to 200 normal cubic meter per kiloliter of oil ($Nm^3$/kl-oil) in the presence of a catalyst comprising molybdenum and at least one metal selected from the group consisting of nickel and cobalt impregnated on aluminum; and (3) contacting said hydrogenated oil with a solid adsorbant to remove residual impurities and produce a high quality refrigerator oil having a pour point of less than −25° C., a cloud temperature of less than −15° C. and a hydrochloric acid generation amount as determined by the sealed tube test of less than 10 milligrams per 4 milliliters.

2. The process according to claim 1, wherein said distillate is Machine grade having a boiling point in the range of from 280° C. (5% point) to 420° C. (95% point) and said high quality refrigerator oil has a two layer-separation temperature of less than 0° C. and deposition does not occur when it is maintained at 170° C. for 12 hours.

3. The process according to claim 2, wherein said solvent extraction is performed under the conditions of a volume ratio of the oil fraction to the solvent is 0.7:1.0–1.2:1.0, a column top temperature of from 60° to 80° C. and a bottom temperature of from 35° to 55° C., and the temperature of the hydrogenation is from 280° to 320° C. when said oil fraction is a vacuum distillate having a boiling point in the range of from 280° C. (5% point) to 420° C. (95% point).

4. The process according to claim 1, wherein said distillate is Motor grade having a boiling point in the range of from 300° C. (5% point) to 510° C. (95% point) and said high quality refrigerator oil has a two layer-separation temperature of less than 20° C. and deposition does not occur when it is maintained at 170° C. for 24 hours.

5. The process according to claim 4, wherein said solvent extraction is performed under the conditions of a volume ratio of the oil fraction to the solvent is 1.5:1.0–2.5:1.0, a column top temperature of from 65° to 85° C. and a bottom temperature of from 35° to 55° C., and the temperature of the hydrogenation is from 310° to 350° C. when said oil fraction is a vacuum distillate having a boiling point in the range of from 300° C. (5% point) to 510° C. (95% point).

6. The process according to claim 1, wherein said solvent extraction is performed under the conditions of a volume ratio of the oil fraction to the solvent is 0.7:1.0–1.2:1.0, a column top temperature of from 60° to 80° C. and a bottom temperature of from 35° to 55° C. when said oil fraction is a vacuum distillate having a boiling point in the range of from 280° C. (5% point) to 420° C. (95% point).

7. The process according to claim 1, wherein said solvent extraction is performed under the conditions of a volume ratio of the oil fraction to the solvent is 1.5:1.0–2.5:1.0, a column top temperature of from 65° to 85° C. and a bottom temperature of from 35° to 55° C. when said oil fraction is a vacuum distillate having a boiling point in the range of from 300° C. (5% point) to 510° C. (95% point).

8. The process according to claim 1, wherein the temperature of the hydrogenation is from 280° to 320° C. when said oil fraction is a vacuum distillate having a boiling point in the range of from 280° C. (5% point) to 420° C. (95% point).

9. The process according to claim 1, wherein the temperature of the hydrogenation is from 310° to 350° C. when said oil fraction is vacuum distillate having a boiling point in the range of from 300° C. (5% point) to 510° C. (95% point).

* * * * *